United States Patent [19]

Landa

[11] Patent Number: 4,531,824

[45] Date of Patent: Jul. 30, 1985

[54] HEATER FOR ELECTROPHOTOGRAPHIC COPIERS

[75] Inventor: Benzion Landa, Edmonton, Canada

[73] Assignee: Savin Corporation, Stamford, Conn.

[21] Appl. No.: 513,726

[22] Filed: Jul. 14, 1983

[51] Int. Cl.[3] ..... G03G 15/00

[52] U.S. Cl. ..... 355/3 FU; 355/30

[58] Field of Search ..... 355/3 FU, 14 FU, 25, 355/26, 3 SH, 30; 219/216, 430; 118/101; 432/231

[56] References Cited

U.S. PATENT DOCUMENTS

| | | | |
|---|---|---|---|
| 3,313,913 | 4/1967 | Limberger | 219/216 |
| 4,034,189 | 7/1977 | Sakamaki | 219/216 |
| 4,121,888 | 10/1978 | Tomura | 355/14 |
| 4,218,128 | 8/1980 | Satomi et al. | 355/14 SH |
| 4,434,353 | 2/1984 | March et al. | 219/216 |

*Primary Examiner*—A. T. Grimley
*Assistant Examiner*—David S. Warren
*Attorney, Agent, or Firm*—Shenier & O'Connor

[57] ABSTRACT

An improved heater for electrophotographic copiers wherein a plurality of laterally spaced heaters dry or fix the transferred image along narrow longitudinally extending strips to prevent smearing of the image from subsequent contact with feed wheels or guides.

6 Claims, 1 Drawing Figure

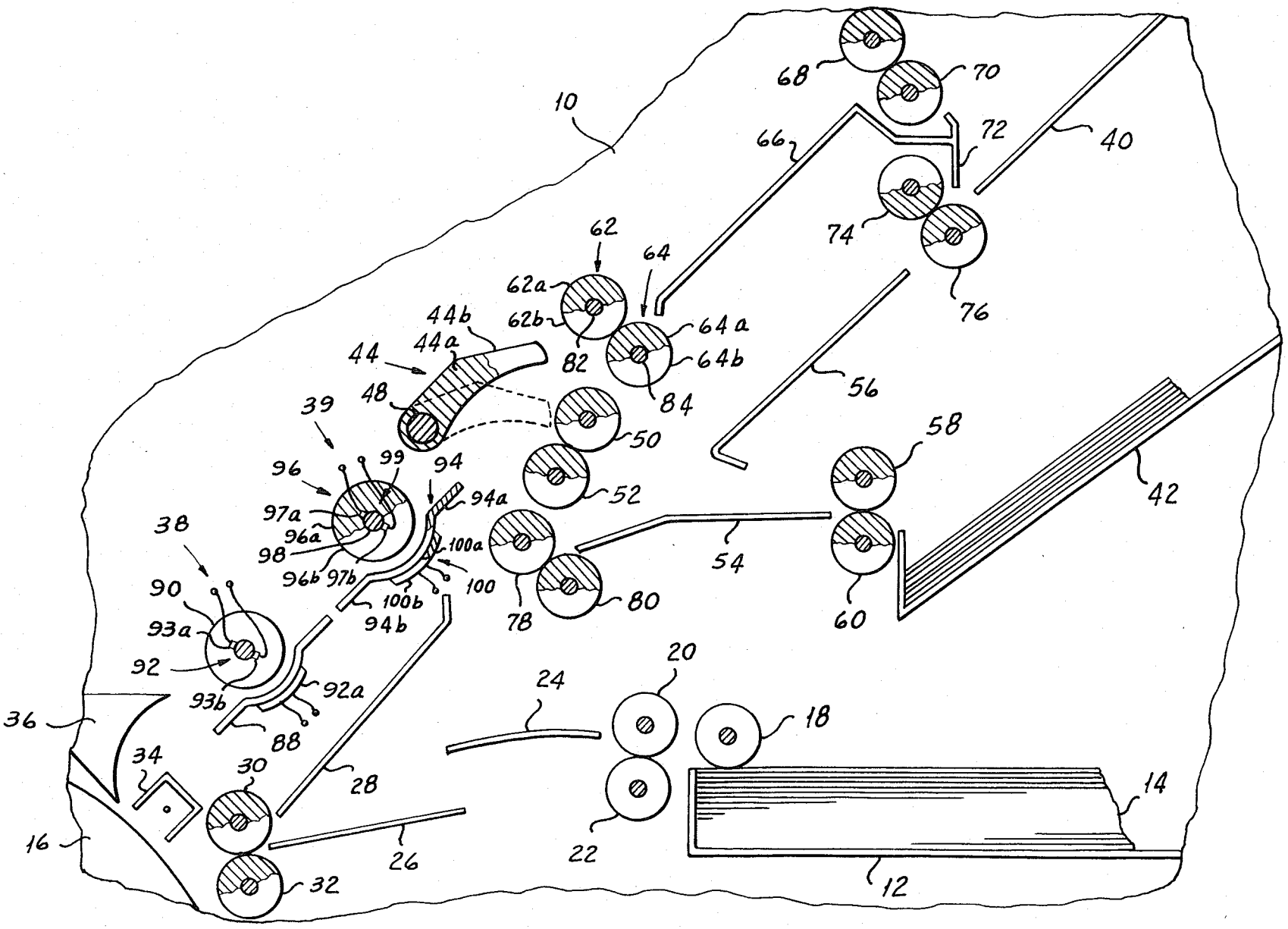
10
12
14
16
18
20
22
24
26
28
30
32
34
36
38
39
40
42
44
44a
44b
48
50
52
54
56
58
60
62
62a
62b
64
64a
64b
66
68
70
72
74
76
78
80
82
84
88
90
92
92a
93a
93b
94
94a
94b
96
96a
96b
97a
97b
98
99
100
100a
100b

HEATER FOR ELECTROPHOTOGRAPHIC COPIERS

FIELD OF THE INVENTION

My invention relates to an improved heater for electrophotographic copiers having feed wheels or guides which contact the image on the copy sheet.

BACKGROUND OF THE INVENTION

In any copier having rollers or guides which contact the image bearing side of the copy paper, there is a possibility that the image, if not completely dried or fixed, may be smeared along the points of contact. As the rollers are usually narrow in relation to the width of the paper, they contact narrow strips of the image running the length of the copy sheet.

Electrophotographic copiers often include a duplexing system in which images are provided on both sides of the copy sheet. In this case, contact of the feed wheels may result in smearing of the image along the narrow strips of contact on both sides of the sheet. This smearing is possible even after the copy sheet has passed through a conventional heater, if the image is not completely dried or fixed.

SUMMARY OF THE INVENTION

One object of my invention is to provide an improved heater for an electrophotographic copier which completely dries or fixes a plurality of narrow strips running the length of the copy paper.

Another object of my invention is to provide an improved heater for an electrophotographic copier which is of relatively small size and may be easily deployed in the paper path of the copier.

Still another object of my invention is to provide an improved heater for an electrophotographic copier which has a relatively small power consumption.

A further object of my invention is to provide an improved heater for an electrophotographic copier which efficiently prevents smearing of narrow strips of image running the length of the copy paper caused by subsequent contact with feed wheels or guides.

Other and further objects will appear from the following description.

BRIEF DESCRIPTION OF THE DRAWINGS

The accompanying drawing, which forms part of the instant specification and is to be read in conjunction therewith, is a fragmentary side sectional view with parts broken away of a duplexing electrophotographic copier incorporating corporating my heater.

DESCRIPTION OF THE PREFERRED EMBODIMENT

Referring now to the drawing, there is shown a duplexing electrophotographic copier capable of producing an image on both sides of a copy sheet. A paper storage tray 12 is adapted to hold a stack of blank copy sheets 14. As is well known to the art, a latent electrostatic image of an original to be copied is formed on the surface of a photoconductor drum 16. After the image has been formed it is developed by the application of toner particles thereto; and following development the image is transferred to a copy sheet.

A prefeed roller 18 is adapted to be operated to remove a sheet 14 from the top of the stack on tray 12. Feed rollers 20 and 22 then move the sheet along a plurality of paper guides 24, 26 and 28 to the nip formed by a pair of registration rollers 30 and 32. As is known to the art, the registration rollers are driven to move the leading edge of the sheet onto the drum surface under a transfer corona 34 as the leading edge of the developed image on the surface of drum 16 passes thereunder. The developed image is thus transferred to the copy sheet. A pick-off assembly 36 then removes the image-bearing sheet from the drum and directs it first through a conventional full-width heater 38 and then through a narrow-strip heater 39 to dry and fix the image, as more fully described hereinafter.

After leaving the heaters 38 and 39, the sheet is directed either to a duplex transit tray 40 or to an exit tray 42 by a selector assembly 44. Assembly 44 consists of a plurality of spaced fingers 44*a*, 44*b*, etc., mounted on a shaft 48, one end of which is journalled in a side wall 10, adapted to be rotated selectively to move the fingers between an upper duplexing position, shown in full lines, and a lower simplex position, shown in broken lines. In the lower simplex position, fingers 44 direct the copy sheet to feed rollers 50 and 52, which advance the sheet along paper guides 54 and 56 to the nip formed by exit rollers 58 and 60. The exit rollers are driven to deposit the sheet in an exit tray 42.

In the duplex position, fingers 44 direct the copy sheet to feed rollers 62 and 64, which advance the sheet along paper guide 66 to transit tray feed rollers 68 and 70. Feed rollers 68 and 70 are driven to deposit the copy sheet, image side up, on the transit tray 40. Tray 40 is inclined sufficiently that the copy sheet slides downwardly thereon, trailing edge first. Guide 72 insures that this trailing edge slides into the nip formed by feed rollers 74 and 76.

Rollers 74 and 76 drive the copy sheet along guides 56 and 54 to feed rollers 78 and 80 which advance it to the nip formed by registration rollers 30 and 32. Registration rollers 30 and 32 are again driven to move what is now the leading edge of the copy sheet onto the drum surface under transfer corona 34 as the leading edge of the developed image on the surface of drum 16 passes thereunder.

It will readily be appreciated that as the original trailing edge of the copy sheet is now the leading edge, it is preferable to use this duplexing system in conjunction with an automatic document feeder, which not only turns over the original but also reverses its ends. This assures that the two-sided copy will be a true representation of the two-sided original.

Pick-off assembly 36 then removes the sheet, now having images on both sides, from drum 16 and directs it a second time through my improved heaters 38 and 39 to fingers 44, which are now in their lower simplex position. Thus each image is heated immediately after image transfer; and for duplex operation heater 38, as well as heater 39, is used twice for each copy sheet. The copy sheet continues through feed rollers 50 and 52 and exit rollers 58 and 60 to the exit tray 42.

Roller 62 comprises a plurality of feed wheels 62*a*, 62*b*, etc., mounted on a common shaft 82; and roller 64 comprises a corresponding plurality of feed wheels 64*a*, 64*b*, etc., mounted on a common shaft 84. One end of each of shafts 82 and 84 is journalled in side wall 10. The feed wheels each have a length of one-quarter inch, for example. Typically three feed wheels are provided, one contacting each margin and one contacting the center of the copy sheet. The feed wheels of rollers 62 and 64 are of course aligned with one another.

Each of the rollers contacting the copy sheet after image transfer should have the same number and lateral disposition of feed wheels as rollers 62 and 64. Such rollers include 68–70, 74–76, 78–80, 30–32, 50–52, and 58–60. Furthermore the number and lateral disposition of fingers 44 should also be the same as that of the feed wheels of rollers 62 and 64. Thus frictional contact of the feed wheels and fingers 44 with the copy sheet will be confined to, for example, three strips extending longitudinally of the copy sheet.

My improved heater includes a full-width heater assembly 38 comprising a generally rectangular plate 88 disposed downstream of the pick-off assembly 36 and extending across the full width of the copy sheet. Plate 88 is provided with a transversely extending curved recess. A knurled roller 90 extends across the full width of the copy sheet and projects slightly into the recess in plate 88 so that the copy sheet will be contacted on both sides. The knurling of roller 90 inhibits squashing or smearing of the freshly transferred image. Mounted within knurled roller 90 is an electrical heating element 92 which is excited by brushes 93*a* and 93*b*. Plate 88 is provided with an electrical heater 92*a*. The heating elements 92 and 92*a* substantially dry or fix the image. However, smearing of the image may result if immediate contact is made with guide fingers 44 or the feed wheels of rollers 50 or 62.

Upon exiting heater 38, the copy sheet moves toward a plurality 94 of curved strips 94*a*, 94*b*, etc., each similar in shape to plate 88 but having the approximate width of that of a feed wheel, such as 62*a*. Mounted on a shaft 98 are a plurality 96 of knurled heating wheels 96*a*, 96*b*, etc. One end of shaft 98 is journalled in side wall 10. Each heating wheel, such as 96*a*, projects into the recess in the cooperating strips, such as 94*a*. The number and lateral disposition of heating wheels 96 and heating strips 94 should be the same as that of fingers 44. Each knurled wheel 96 is provided with a corresponding electrical heating element 99, which heating elements are excited in series by brushes 97*a* and 97*b*. The heating strips, such as 94*a* and 94*b*, are each provided with a corresponding electrical heating element, 100*a* and 100*b*, which heating elements may be excited in series with one another. Typically, the power consumption of heater 39 may be approximately one-tenth that of heater 38.

During normal operation of my improved heaters 38 and 39, the copy sheet, with image initially on one side only, moves between heating roller 90 and plate 88 which substantially dry or fix the image. The sheet then moves between heating wheels 96 and strips 94 which completely dry or fix those strip portions of the image which will subsequently come into contact with fingers 44 and either roller 50, for simplex operation, or roller 62, for duplex operation.

If the copy sheet is to be duplexed, it is returned under transfer corona 34, where an image is applied to the remaining blank side. The sheet then moves through my improved heaters 38 and 39 a second time, again substantially drying or fixing the entire image first and then completely drying or fixing those strip portions which will subsequently come into contact with fingers 44, roller 50 and exit roller 58.

It will be understood that the sequence may be reversed by reversing the full-width and narrow strip heaters 38 and 39. In such event, the strip portions would be substantially dried first by heater 39. Then heater 38 would completely dry or fix the strip portions and substantially dry or fix the remainder of the sheet. The arrangement shown is, however, to be preferred for liquid development since the strip portions are more completely dried along their margins. Two heaters spaced appreciably along the direction of movement of the paper provide a more completely dry liquid developed image than a single heater for the same total power consumption.

While I have described the use of my improved heater in a duplexing system, it could be employed in the paper path of any copier selectively to dry or fix the narrow strips of image on a copy sheet which will subsequently come into contact with feed wheels or guides.

It will be seen that I have accomplished the objects of my invention. I have provided an improved heater which may easily be deployed in the paper path of an electrophotographic copier. The use of my heater does not result in an appreciable increase in power consumption. My heater efficiently prevents smearing of narrow strips of image running the length of the copy paper from subsequent contact with feed wheels or guides.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. An electrophotographic copier including in combination means for transferring to one side of a carrier sheet a visible toned image, means for transporting the sheet along a path, said transporting means comprising a plurality of narrow drive elements widely spaced transversely of the path and contacting a portion of said side of the sheet, first means extending transversely of the path for uniformly heating the entire sheet, and second means for preferentially heating a corresponding plurality of narrow strips of the sheet spaced transversely of and extending along the path, each strip being aligned with a corresponding drive element, said first and second heating means being disposed at respective first and second positions spaced long the path.

2. Apparatus as in claim 1 wherein the second heating means comprises a corresponding plurality of heating elements spaced transversely of the path.

3. Apparatus as in claim 1 wherein said positions are such that the sheet is heated initially by the first means and subsequently by the second means.

4. Apparatus as in claim 3 wherein the visible toned image is produced by liquid development and wherein the first and second heating means respectively dry the entire sheet and narrow strips thereof spaced transversely of and extending along the path.

5. A liquid developed electrophotographic copier including in combination means for transferring to one side of a carrier sheet a liquid developed visible toned image, means for transporting the sheet along a path, said transporting means comprising a plurality of narrow drive elements widely spaced transversely of the path and contacting a portion of said side of the sheet, and means for preferentially heating and drying a corresponding plurality of narrow strips of the sheet spaced transversely of the path, each dried strip being aligned with a corresponding drive element and extending the full length of the sheet along the path.

6. Apparatus as in claim 5 wherein the drying means comprises a corresponding plurality of heating elements spaced transversely of the path.

* * * * *